US006402544B1

(12) United States Patent
Barnett

(10) Patent No.: US 6,402,544 B1
(45) Date of Patent: Jun. 11, 2002

(54) ELECTRICAL CONNECTOR WITH IDC SCREW

(75) Inventor: Gary Barnett, Ashby de la Zouch (GB)

(73) Assignee: B & H (Nottingham) Limited (GB)

( * ) Notice: Subject to any disclaimer, the term of this patent is extended or adjusted under 35 U.S.C. 154(b) by 0 days.

(21) Appl. No.: 09/890,819

(22) PCT Filed: Feb. 3, 2000

(86) PCT No.: PCT/GB00/00309

§ 371 (c)(1),
(2), (4) Date: Sep. 1, 2001

(87) PCT Pub. No.: WO00/46878

PCT Pub. Date: Aug. 10, 2000

(30) Foreign Application Priority Data

Feb. 4, 1999 (GB) ..... 9902358

(51) Int. Cl.[7] ..... H01R 4/24
(52) U.S. Cl. ..... 439/416
(58) Field of Search ..... 439/416, 412, 439/413, 431, 433, 870, 872, 873, 874, 415, 811, 287, 293

(56) References Cited

U.S. PATENT DOCUMENTS 3,865,007 A * 2/1975 Stanback ..... 85/61
4,466,691 A * 8/1984 Battenx ..... 439/272 R
5,314,359 A * 5/1994 Probst ..... 439/766
5,332,153 A * 7/1994 Leibhard et al ..... 238/373
6,042,430 A * 3/2000 Hollick
6,186,716 B1 * 2/2001 West et al. ..... 411/30
6,193,719 B1 * 2/2001 Gournay et al. ..... 606/61

FOREIGN PATENT DOCUMENTS

EP 0 020 229 A 12/1980
EP 0 067 917 A 12/1982
GB 2 281 599 A 3/1995

* cited by examiner

*Primary Examiner*—Tho D. Ta
*Assistant Examiner*—P Nguyen
(74) *Attorney, Agent, or Firm*—Young & Basile, P.C.

(57) ABSTRACT

An electrical connector has a connector body including a socket for an electrical conductor, the connector body having an electrically insulating shroud and having a threaded bore in which a connecting bolt is threadedly engaged. The connecting bolt is capable of actuation into engagement with a conductor inserted into the socket by providing a drive member engaged with the connecting bolt and extending through an opening in the insulating shroud to a rotatable, electrically insulating cap. The connecting bolt is slidably mounted on the drive member, the drive member being adapted to shear at a position between the opening in the insulating shroud and the point of engagement of the drive member with the connecting bolt when a predetermined torue is applied to the drive member, such that the cap and a residual portion of the drive member attached thereto can be withdrawn from the opening in the insulating shroud. The opening in the insulating shroud is adapted substantially to close after the drive member has so sheared and been withdrawn.

16 Claims, 4 Drawing Sheets

ELECTRICAL CONNECTOR WITH IDC SCREW

BACKGROUND OF THE INVENTION

This invention relates to an electrical connector, and in particular to an electrical connector suitable for use with live electrical conductors.

It is often necessary to connect one electrical conductor to an existing conductor, eg where a service cable is connected to an existing mains cable. To save time and avoid disruption of supply it is often desirable that this be done without removing the electrical supply to the mains cable, ie to make the connection while the mains cable is live. However, this obviously presents a safety hazard and special designs of connector are often employed to minimise or eliminate the risk to an operative engaged in making the connection. Various designs of such connectors have been proposed but none has been found to be completely satisfactory. For instance, such connectors either fail to provide satisfactory insulation (during or after installation) or have bulky insulated mechanisms leading to increased encapsulation costs.

SUMMARY OF THE INVENTION

There has now been devised an electrical connector which is suitable for use with live conductors and which overcomes or substantially mitigates disadvantages associated with the prior art.

According to the invention, there is provided an electrical connector comprising a connector body including a socket for an electrical conductor, the connector body having an electrically insulating shroud and having a threaded bore in which a connecting bolt is threadedly engaged, the connecting bolt being capable of actuation into engagement with a conductor inserted into the socket by means of a drive member engaged with the connecting bolt and extending through an opening in the insulating shroud to a rotatable, electrically insulating cap, wherein the connecting bolt is slidably mounted on the drive member, the drive member being adapted to shear at a position between the opening in the insulating shroud and the point of engagement of the drive member with the connecting bolt when a predetermined torque is applied to the drive member, such that the cap and a residual portion of the drive member attached thereto can be withdrawn from the opening in the insulating shroud, and the opening in the insulating shroud being adapted substantially to close after the drive member has so sheared and been withdrawn.

The connector according to the invention is advantageous primarily in that it reduces or eliminates the risk of exposure of an operative to electrically live surfaces during the fitting of the connector, even to an electrically live conductor. After installation the bulk of the insulated mechanism can be removed without exposing live metalwork, thus reducing the volume of encapsulant required without compromising the safety of the installer. The connector is nonetheless simple to use, and of compact design.

The connector body is of electrically conducting material, most commonly a metal such as aluminium or brass. The socket may be a bore formed in a unitary connector body. Alternatively, the socket may be defined by a channel between two components held in fixed relationship.

The connector body may include one or more sockets for receiving a corresponding number of conductors. Each such socket may be provided with one or more connecting bolts.

The insulating shroud applied to the connector body is most preferably a plastics coating. The shroud may be applied to the connector body, or to the components which make up the connector body, by any of a number of techniques. For example, the shroud may be formed as an injection-moulded component which snaps into place, or the body or component may be dipped in molten plastics material.

The connecting bolt is preferably formed on the end which engages the conductor with insulation piercing formations. This eliminates the need to strip insulation from the conductor before installing the connector and further reduces the risk of exposing the installer to live metalwork.

The drive member preferably comprises a pin or rod with a cross-section which is of non-circular, eg hexagonal, form, at least in its part which engages the connecting bolt. The drive member preferably engages in an axial bore of corresponding shape in the connecting bolt.

The drive member may be formed integrally with the cap, eg by being moulded with the cap in plastics material. Alternatively, the drive member may be formed in metal, eg brass or steel, and the cap may be moulded in plastics material about one end of the drive member.

The drive member is preferably provided with a local weakening, eg a waist or the like, which shears at a predetermined torque.

The electrically insulating shroud preferably covers the opening of the threaded bore, extending up to the portion of the drive member which extends through the shroud. In the region of the opening, the shroud preferably takes the form of a petal washer or the like, ie it is formed with a number of leaves which are resiliently deformed by the drive member but which relax to cover the opening of the threaded bore when the drive member shears and is removed with the cap. Such leaves may be formed as part of a separate bushing which is fitted into the opening in the insulating shroud.

BRIEF DESCRIPTION OF THE DRAWINGS

The invention will now be described in greater detail, by way of illustration only, with reference to the accompanying drawings, in which.

DESCRIPTION OF THE PREFERRED EMBODIMENT

Figure 1:
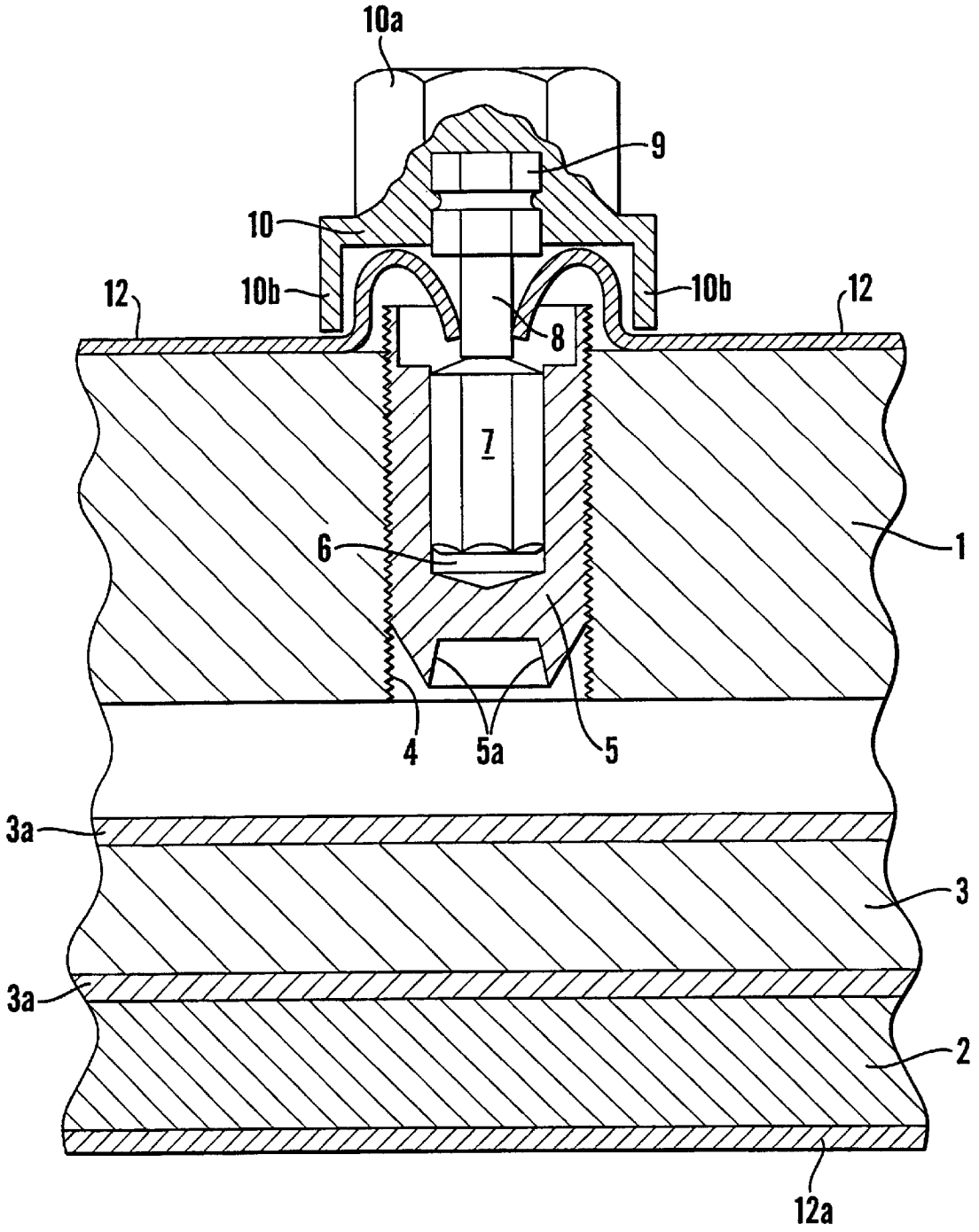
FIG. 1 is a fragmentary side view in section of an electrical connector according to the invention in a first stage of use.

Referring first to FIG. 1, an electrical connector comprises a body 1 of electrically conductive material (typically a metal such as brass or aluminium) which is provided on its surface with an electrically-insulating plastics shroud 12. The body 1 is either formed integrally with, or is fastened to, a reaction member 2, the space between the body 1 and the reaction member 2 defining a channel or bore in which an electrical conductor 3 can be received. The conductor 3 is typically a solid conductor with a plastics sheath 3*a*. The reaction member 2 is also coated with an insulating shroud 12*a*, which may be integral with the shroud 12.

The body 1 has a threaded bore 4 within which a connecting bolt 5 is received. The bolt 5 is formed at its lower end (as viewed in the Figures) with insulation-piercing formations 5*a* which, when the bolt is brought into engagement with the conductor 3 in the manner described below, penetrate the plastics sheath 3*a* such that electrical connection is established between the conductor 3 and the bolt 5. The bolt 5 may be of any electrically conducting material but is typically brass, copper or aluminium.

A blind bore 6 of hexagonal (or other non-circular) cross-section is broached within the bolt 5 and extends along the greater part of the longitudinal axis of the bolt 5. A drive spindle 7, typically of brass or steel, with a cross-section matching that of the bore 6 is received within the bore 6 with a close sliding fit. The spindle 7 has a co-axial, upwardly extending extension piece 8 which terminates in a head 9. The junction between the spindle 7 and the extension piece 8 constitutes a neck at which the assembly can shear, as described below, when a predetermined torque is applied to the extension piece 8.

A cap 10 of plastics material is moulded about the head 9. The cap 10 has an hexagonal upper portion 1O*a*, which is dimensioned to fit a suitable tool, and a downwardly depending circular skirt 10*b* which rests on the upper surface of the shroud 12. In the region encompassed by the skirt 10*b*, the shroud 12 extends across the open upper end of the threaded bore 4, the shroud 12 in this region adopting the form of a petal washer, through the centre of which the extension piece 8 extends.

FIG. 1 shows the components of the connector in the condition in which they are assembled and supplied, immediately after the conductor 3 has been received in the channel between the body 1 and the reaction member 2. In this condition, all readily accessible surfaces of the connector are electrically insulated, either by the shroud 12 or by the cap 10. Likewise, the conductor 3 is insulated by its plastics sheath 3*a*. Thus, the connector can safely be fitted around the conductor 3 when the conductor 3 is live.

To establish connection between the conductor 3 and the body 1 of the connector, the cap 10 is rotated by means of a spanner, socket wrench or the like. Rotation of the cap 10 causes rotation of the spindle 7 and this in turn rotates the bolt 5 within the threaded bore 4. The spindle 7 is held in a constant position relative to the body 1 by the skirt 10*b*, but the bolt 5 is driven downwards into contact with the plastics sheath 3*a* of the conductor 3. The spindle 7 thus remains captive within the blind bore 6 but slides relative to the bolt 5.

Figure 2:
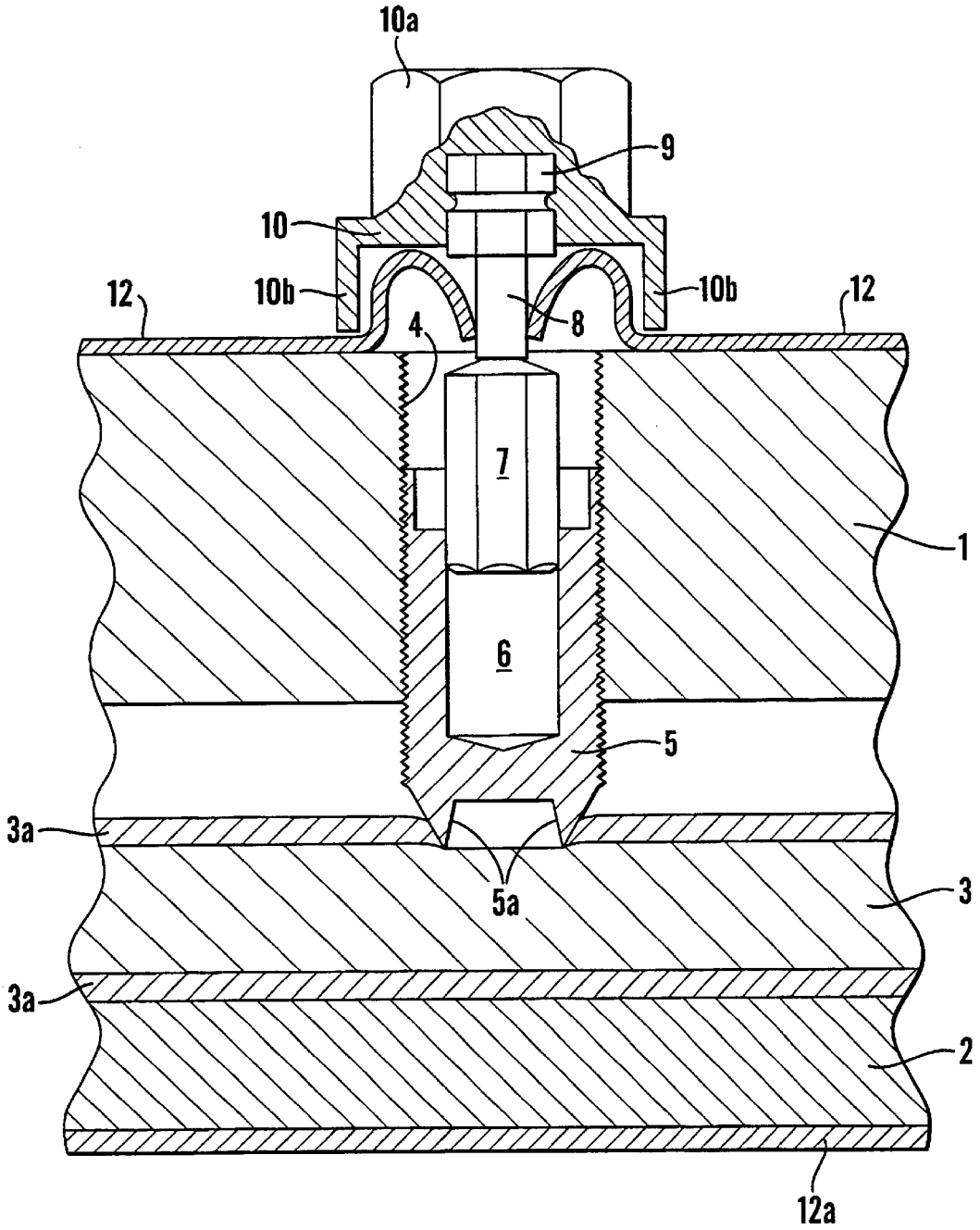
FIG. 2 is a view similar to FIG. 1 of the connector in an intermediate stage of use.

Continued rotation of the cap 10 causes the insulation-piercing formations 5*a* to penetrate through the plastics sheath 3*a* and to come into contact with the live conductor 3 (see FIG. 2). Engagement of the tip of the bolt 5 with the conductor 3 produces a resistance to further rotation of the cap 10. The torque applied to the spindle 7 thus increases and a point is reached at which the extension piece 8 shears from the spindle 7. The cap 10 with the captive extension piece 8 is thus released from the connector, as shown in FIG. 3.

Figure 3:
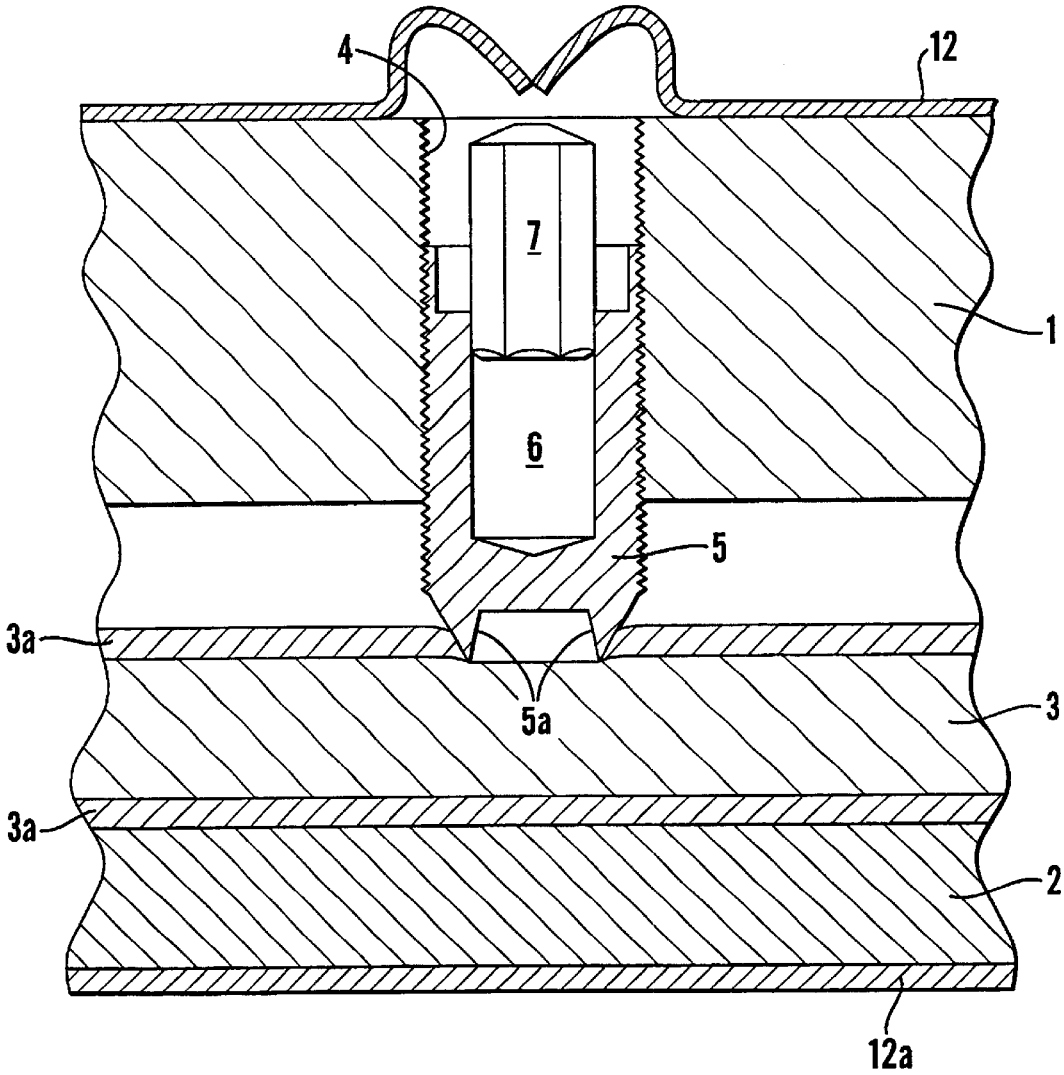
FIG. 3 is a view similar to FIGS. 1 and 2 of the connector in a final stage of use.

When the cap 10 and extension piece are so removed, the portions of the plastics sheath 12 which previously surrounded the extension piece 8 relax to the positions shown in FIG. 3, in which they substantially close the opening of the bore 4. Thus, electrical connection is established between the conductor 3 and the body 1 of the connector, without exposing the operator at any time to any electrically live surfaces.

In the embodiment described above, the spindle 7 and extension piece 8 are of metal. It will be appreciated, however, that these components do not need to be electrically conducting. A metal such as brass is used merely because it enables the extension piece and spindle to be produced with the requisite mechanical strength and to shear at the desired torque. In principle, the spindle, extension piece and the cap could be moulded integrally in plastics material, if such a material also provides these properties.

Figure 4:
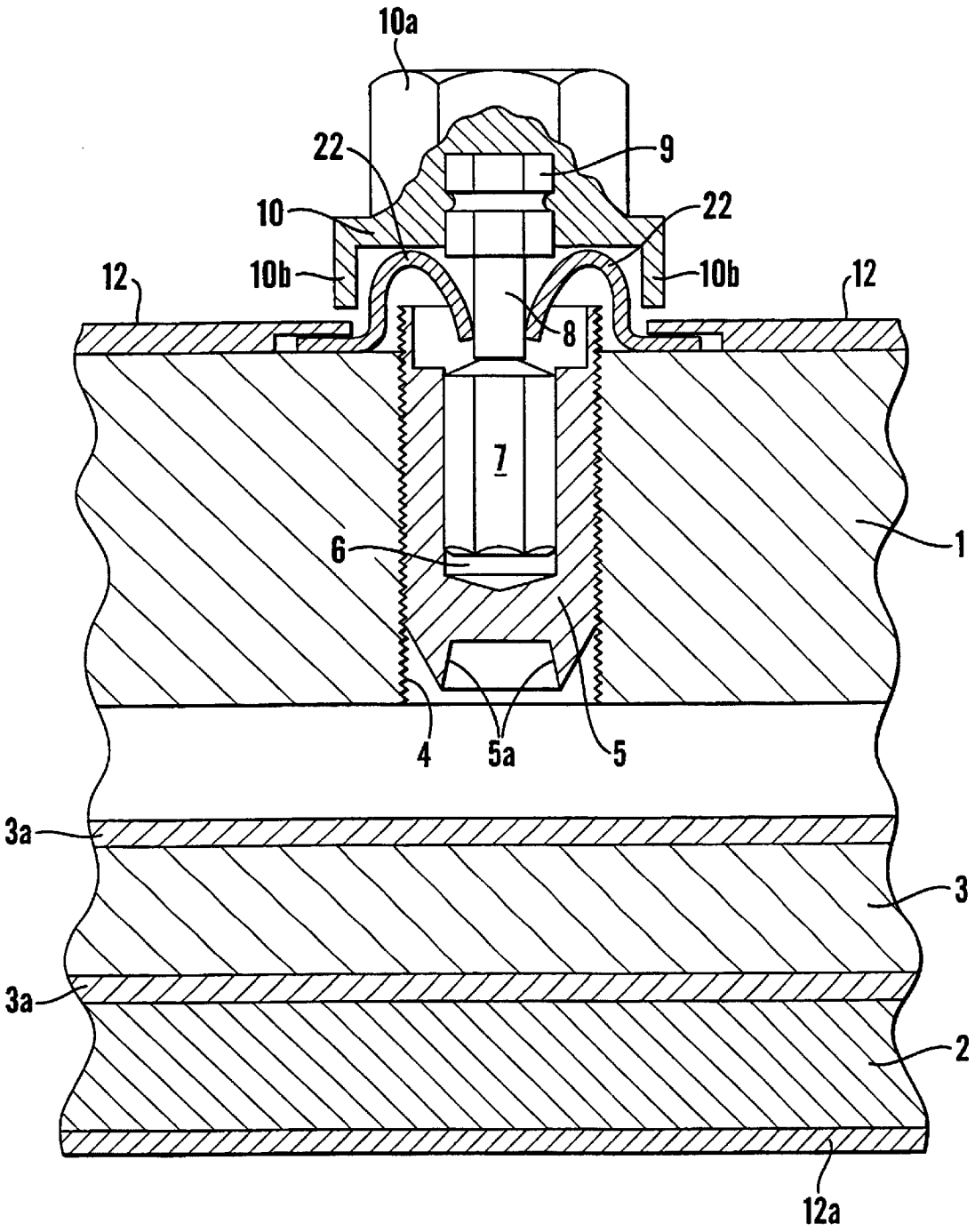
FIG. 4 is a view similar to FIG. 1 of a second embodiment of the invention.

FIG. 4 shows a view similar to FIG. 1 of a second embodiment incorporating another possible modification. In FIG. 4, components corresponding to those of the FIG. 1 embodiment are identified by the same reference numerals. This embodiment differs from that of FIG. 1 in that the open upper end of the threaded bore 4 is closed by a separate bushing 22 which is overlaid around its periphery, and retained in place, by the shroud 12. Thus, in this embodiment the petal washer-like component which closes the upper end of the threaded bore 4 is a separate component rather than being formed integrally with the shroud 12.

What is claimed is:

1. An electrical connector comprising a connector body including a socket for an electrical conductor, the connector body having an electrically insulating shroud and having a threaded bore in which a connecting bolt is threadedly engaged, the connecting bolt being capable of actuation into engagement with a conductor inserted into the socket by means of a drive member engaged with the connecting bolt and extending through an opening in the insulating shroud to a rotatable, electrically insulating cap, wherein the connecting bolt is slidably mounted on the drive member, the drive member being adapted to shear at a position between the opening in the insulating shroud and the point of engagement of the drive member with the connecting bolt when a predetermined torque is applied to the drive member, such that the cap and a residual portion of the drive member attached thereto can be withdrawn from the opening in the insulating shroud, and the opening in the insulating shroud being adapted substantially to close after the drive member has so sheared and been withdrawn.

2. A connector as claimed in claim 1, wherein the insulating shroud is a plastics coating.

3. A connector as claimed in claim 1, wherein the electrically insulating shroud covers the opening of the threaded bore, extending up to the portion of the drive member which extends through the shroud.

4. A connector as claimed in claim 1, wherein the shroud is formed with a number of leaves which are resiliently deformed by the drive member but which relax to cover the opening of the threaded bore when the drive member shears and is removed with the cap.

5. A connector as claimed in claim 4, wherein the leaves are formed as part of a separate bushing which is fitted into the opening in the insulating shroud.

6. A connector as claimed in claim 1, wherein the connecting bolt is formed on the end which engages the conductor with insulation piercing formations.

7. A connector as claimed in claim 1, wherein the drive member comprises a pin or rod with a cross-section which is of non-circular form, at least in its part which engages the connecting bolt.

8. A connector as claimed in claim 7, wherein the drive member engages in an axial bore of corresponding shape in the connecting bolt.

9. A connector as claimed in claim 1, wherein the drive member is formed integrally with the cap by moulding in plastics material.

10. A connector as claimed in claim 1, wherein the drive member is formed in metal and the cap is moulded in plastics material about one end of the drive member.

11. A connector as claimed in claim 1, wherein the drive member is provided with a local weakening which shears at a predetermined torque.

12. A connector as claimed in claim 1, wherein the connector body is of electrically conducting material.

13. A connector as claimed in claim 12, wherein the connector body is of aluminium or brass.

14. A connector as claimed in claim 1, wherein the socket is a bore formed in a unitary connector body.

15. A connector as claimed in claim 1, wherein the socket is defined by a channel between two components held in fixed relationship.

16. A connector as claimed in claim 1, which includes a plurality of sockets for a corresponding number of electrical conductors.

* * * * *